US006908080B2

(12) United States Patent
Wolf

(10) Patent No.: US 6,908,080 B2
(45) Date of Patent: Jun. 21, 2005

(54) DEVICE FOR FORMING AND CONVEYING AWAY A SHEET STACK WITH THE AID OF A SEPARATING MECHANISM

(75) Inventor: Wolfram Wolf, Bilsen (DE)

(73) Assignee: E.C.H. Will GmbH, Hamburg (DE)

( * ) Notice: Subject to any disclaimer, the term of this patent is extended or adjusted under 35 U.S.C. 154(b) by 176 days.

(21) Appl. No.: 10/374,527

(22) Filed: Feb. 27, 2003

(65) Prior Publication Data

US 2003/0160384 A1 Aug. 28, 2003

(30) Foreign Application Priority Data

Feb. 27, 2002 (DE) ..... 102 08 309

(51) Int. Cl.[7] ..... B65H 5/00; B65H 5/04
(52) U.S. Cl. ..... 271/10.14
(58) Field of Search ..... 271/10.04, 10.6, 271/10.01, 8.1, 42, 128, 4.01, 4.04, 4.11, 10.14

(56) References Cited

U.S. PATENT DOCUMENTS 5,669,755 A 9/1997 Zahn
5,785,309 A * 7/1998 Halup et al. ..... 271/11

FOREIGN PATENT DOCUMENTS

| | | |
|---|---|---|
| DE | 27 25 267 B1 | 11/1978 |
| DE | 198 49 859 A1 | 5/2000 |
| EP | 1 400 473 A1 | 3/2004 |

OTHER PUBLICATIONS

Patent Abstracts of Japan, vol. 004, No. 092 (M–018), Jul. 3, 1980 and JP 55 048148A (Dainippon Printing Co. Ltd.), Apr. 5, 1980.

* cited by examiner

*Primary Examiner*—Donald P. Walsh
*Assistant Examiner*—Mark J. Beauchaine
(74) *Attorney, Agent, or Firm*—Venable LLP; Catherine M. Voorhees

(57) ABSTRACT

A device for manipulating sheet stacks in a stack repository includes a sheet feeding device and a mechanism for separating adapted to be moved into the stack repository while a sheet stack is conveyed away from the stack repository. The separating mechanism includes a belt element.

22 Claims, 3 Drawing Sheets

DEVICE FOR FORMING AND CONVEYING AWAY A SHEET STACK WITH THE AID OF A SEPARATING MECHANISM

CROSS-REFERENCE TO RELATED APPLICATION

This application claims the priority of German Patent Application No. 102 08 309.6 filed Feb. 27, 2002. The disclosures of the foregoing priority application and of each and every U.S. and foreign patent and patent application mentioned herein are incorporated herein by reference.

BACKGROUND OF THE INVENTION

The invention relates to a separating mechanism for use with a device for forming sheet stacks in a stack repository and conveying the sheet stacks away from the stack repository. The separating device includes a sheet feeding device and a separating mechanism that can be introduced into the stack repository while the sheet stack is conveyed away.

A device for forming and conveying away sheet stacks is known from German patent document DE 198 49 859 A1. With this device, sheets are conveyed with a conveying track into a stack repository. While using a stack withdrawing device to remove the sheet stack from the stack repository, a separating rake is moved synchronously with a withdrawing movement of the stack withdrawing device in the transport direction of the removed sheet stack. The separating rake has an essentially horizontal platform, such that the sheets supplied continuously to the stack repository are deposited on the platform during the removal of a sheet stack.

SUMMARY OF THE INVENTION

In a device for forming and conveying sheet stacks, while a stack is conveyed out of a stack repository adjacent a sheet feeding device, subsequently supplied sheets are deposited on a belt element moved into the stack repository during the removal of a sheet stack. The belt element is moved into the repository such that continuously supplied sheets are collected horizontally in the stack repository. The belt element positioned inside the stack repository is tensioned or rigid enough such that the supplied sheets rest essentially horizontally on the belt element.

The belt element of the present invention results in a simplified design of the device.

In an exemplary embodiment, the belt element is flexible. For example, if the belt element for the sheet repository is not in use, it can be easily stored inside the device, for example, by rolling up the belt element. As a result, the space required for the belt element inside the device can be limited to a minimum. In addition, the belt element can be redirected from a vertical to a horizontal direction and vice versa because of its flexibility to result in further space-saving advantages.

One advantageous modification of the invention provides a belt element section of the belt element with a bending elasticity. The belt element and/or the belt element section can reliably pick up and carry the supplied sheets. The bending elasticity of the belt element and/or the belt element section is such that the subsequently arriving sheets for the next ream or stack are separated and supported. Moreover, the belt element and/or the belt element section can be easily installed in a space-saving manner inside the device.

The belt element can be a steel belt.

At least one guiding device for the belt element is optionally provided, for example, for moving the belt element securely into the stack repository.

In addition, the height of the guiding device is optionally adjustable to ensure that the sheets supplied in a scaled formation are always dropped from the same height while forming a new stack and during the stack replacement.

The belt element can be moved in a reliable and controlled manner into the stack repository by at least one drive provided for the belt element.

The drive can optionally be a motorized or pneumatic drive.

The belt element can optionally be introduced in a sheet transporting direction into the stack repository.

According to one advantageous modification of the invention, the belt element optionally moves synchronously with the withdrawing movement of a stack-withdrawing device.

A separating hook is provided at the stack repository to ensure a secure stack formation. The separating hook causes a finished ream to be separated from the subsequently delivered sheets.

In one embodiment, the separating hook is arranged opposite the sheet feeding device.

In an exemplary embodiment, a separating mechanism is utilized in a device for forming sheet stacks in a stack repository and/or for conveying sheet stacks away from a stack repository. The device includes a sheet feeding device and a separating mechanism that can be moved into the stack repository while a sheet stack is conveyed away. Optionally, the separating mechanism is embodied as a belt element.

BRIEF DESCRIPTION OF THE DRAWINGS

The invention is explained with the aid of the drawings which show at least one exemplary embodiment without restricting the general inventive idea.

DETAILED DESCRIPTION OF THE INVENTION

Figure 1A:
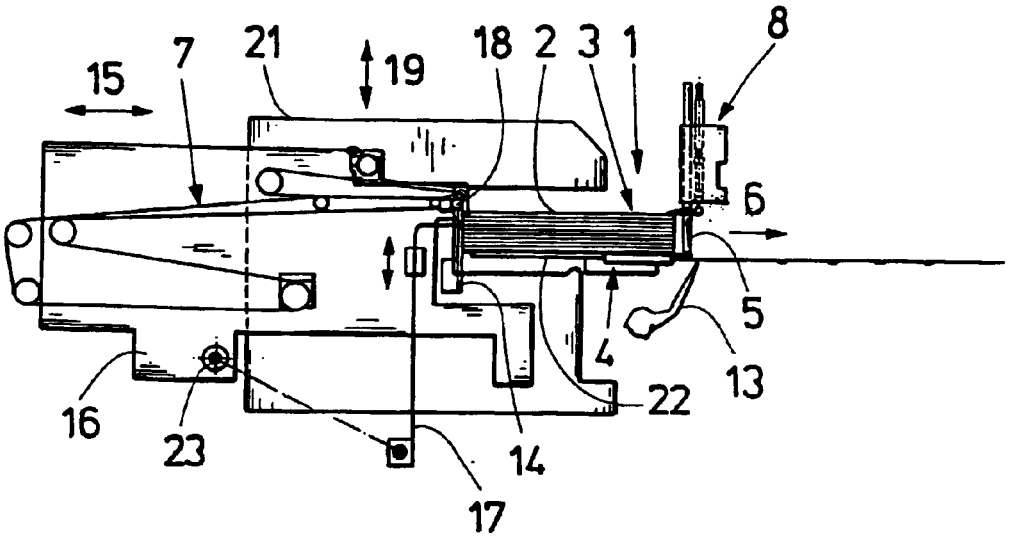
FIGS. 1*a* to 1*d* are side views of the device of the present invention in various operating positions.

Identical or corresponding parts are given the same reference numerals in the drawings and may not be introduced again.

As shown in FIGS. 1*a*–1*d*, a device repository for gathering paper sheets 2 into sheet stacks 3 includes a stack repository 1. The stack is divided into numerous collection boxes 4 arranged one behind the other perpendicular to the drawing plane. Relative to the sheet and/or stack conveying direction, referenced as arrow 6, the collection box 4 is supplied in an upstream direction by a conveying track 7, embodied as a belt track in one exemplary embodiment. The track 7 supplies the paper sheets 2 in a scaled formation. In a downstream direction, the collection box 4 is provided with a stack withdrawing device 8, embodied as tong-like gripper 5 in one exemplary embodiment, and a subsequent transverse conveying arrangement (not shown herein) that can include up and down moving conveying belts and integrated air-table segments.

Figure 1B:
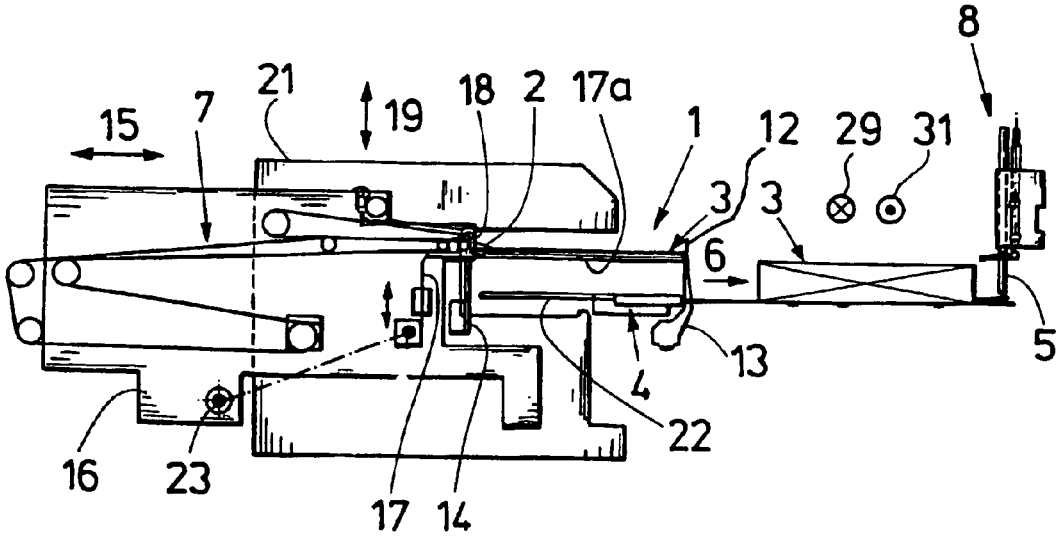

The stack repository 1 is delimited by several stack limiting stops 13 and rear stack limiting stops 14. The first limiting stops can pivot from the operating position shown in FIG. 1*b* into a non-operating position shown in FIG. 1*a*. As also shown in FIG. 1*b*, a separating hook 12 can be arranged on the stack limiting device 13 opposite the sheet feeding device to support the leading sheets of a new stack while a completed stack is removed.

The rear stack limiting stops 14 are mounted on a slide 16. The transport track 7 is also arranged on the slide 16, which can be displaced in the direction of double arrow 15. In a region adjacent the rear stack limit stop 14, the slide 16 is provided with a guide element and/or a guiding device (see FIG. 2) that enables a belt element 17, arranged on and/or inside the slide, to move into the stack repository. Sheets are dropped from one end 18 of transport track 7 at a defined distance to the guide for the belt element 17. The slide 16, in turn, is arranged to be displaceable on a slide carrier 21 that can be adjusted in height, as shown by double arrow 19.

The collection box 4 has a bottom platform 22. The bottom platform 22 can be provided as a complete replacement group with format-dependent, pre-adjusted side limit stops for particular stack characteristics.

A description of the operation of the device is described below. As shown in FIG. 1*a*, a sheet stack 3 is formed by a defined number of gathered paper sheets 2. The front stack limit stop 13 is pivoted away, and the stack is gripped by the tong-like gripper 5 of the stack withdrawing device 8. The stack is then transferred in conveying direction 6 away from the stack repository 1 and onto a crossover conveying arrangement. As shown in FIG. 1*b*, the conveying arrangement then optionally removes the sheet stack in the directions indicated with arrow symbols 29 and/or 31, which are perpendicular to the drawing plane.

Synchronously with the transfer movement of the stack withdrawal device 8, the belt section 17*a* of belt 17 is optionally moved into the region of the stack repository 1 until it is stopped by the stack limiting stop 13 which has again moved back into the limiting stop position. In the process, the paper sheets 2 that are supplied in a scaled formation are simultaneously transferred without interruption onto the horizontal, rigid belt section 17*a*.

Figure 1C:
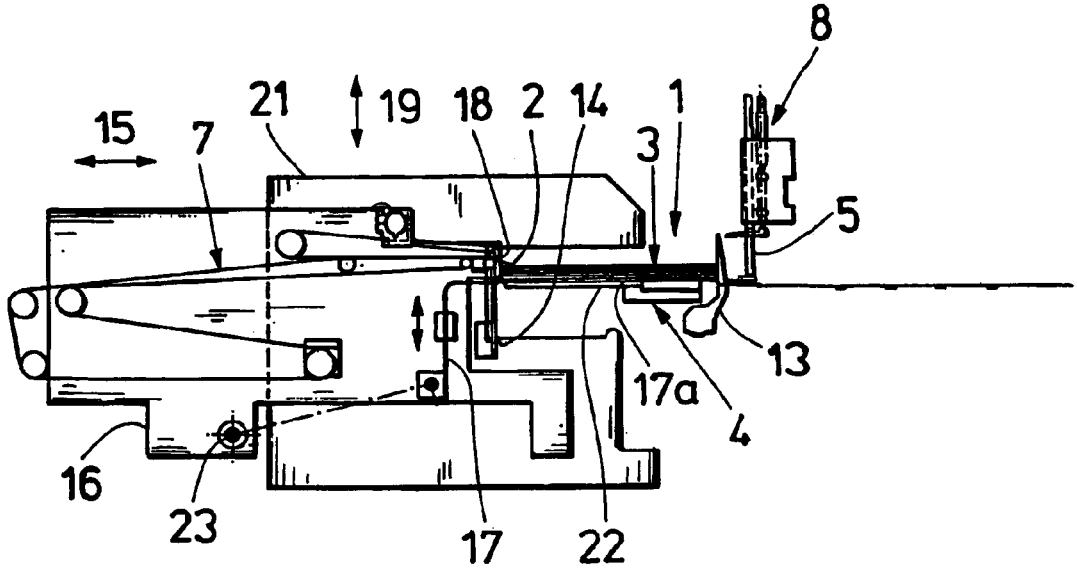
Figure 1D:
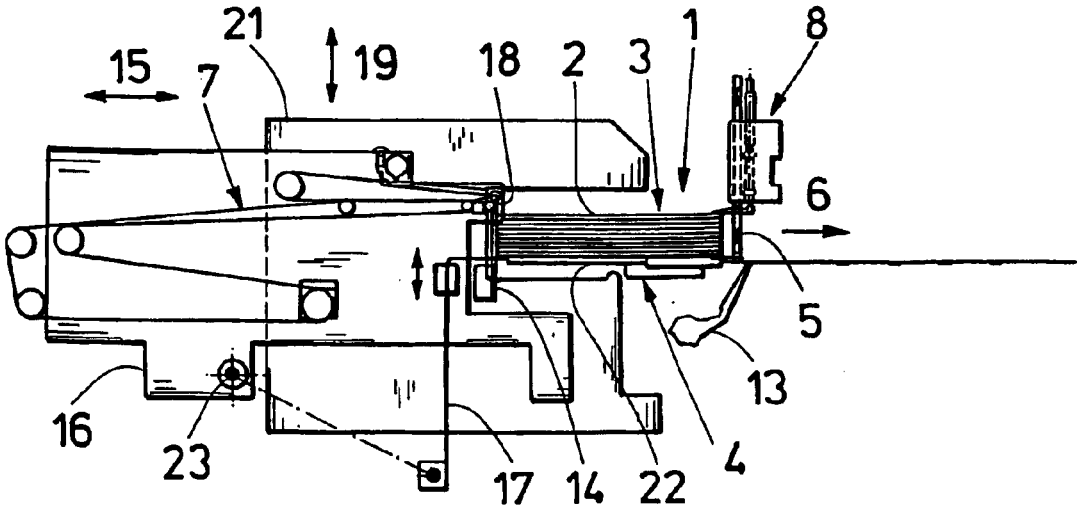

By moving the slide carrier 21 downward in the direction of double arrow 19, as shown in FIG. 1*c*, the section 17*a* of belt 17 is lowered to or below the bottom platform 22 of the stack repository 1. As shown in FIG. 1*d*, the belt section 17*a* is pulled back from the stack repository 1 into the starting position such that the newly forming sheet stack 3 can be supported by the bottom platform 22. The belt element 17 in this case is pulled back with the aid of a motor 23, which is also arranged on the slide 16. The belt element 17 for the exemplary embodiment shown herein is at least partially arranged vertically. When moving the flexible belt 17 into the stack repository 1, a rigid section is formed in the belt itself such that a sheet stack is formed by horizontally deposited and stacked sheets.

As a result of the subsequent upward movement of the slide carrier 21 in the direction of double arrow 19, the conveying track end 18 from which the sheets are dropped is lifted up to match the increase in the height of sheet stack 3 in order to ensure a uniform paper drop height.

Figure 2:
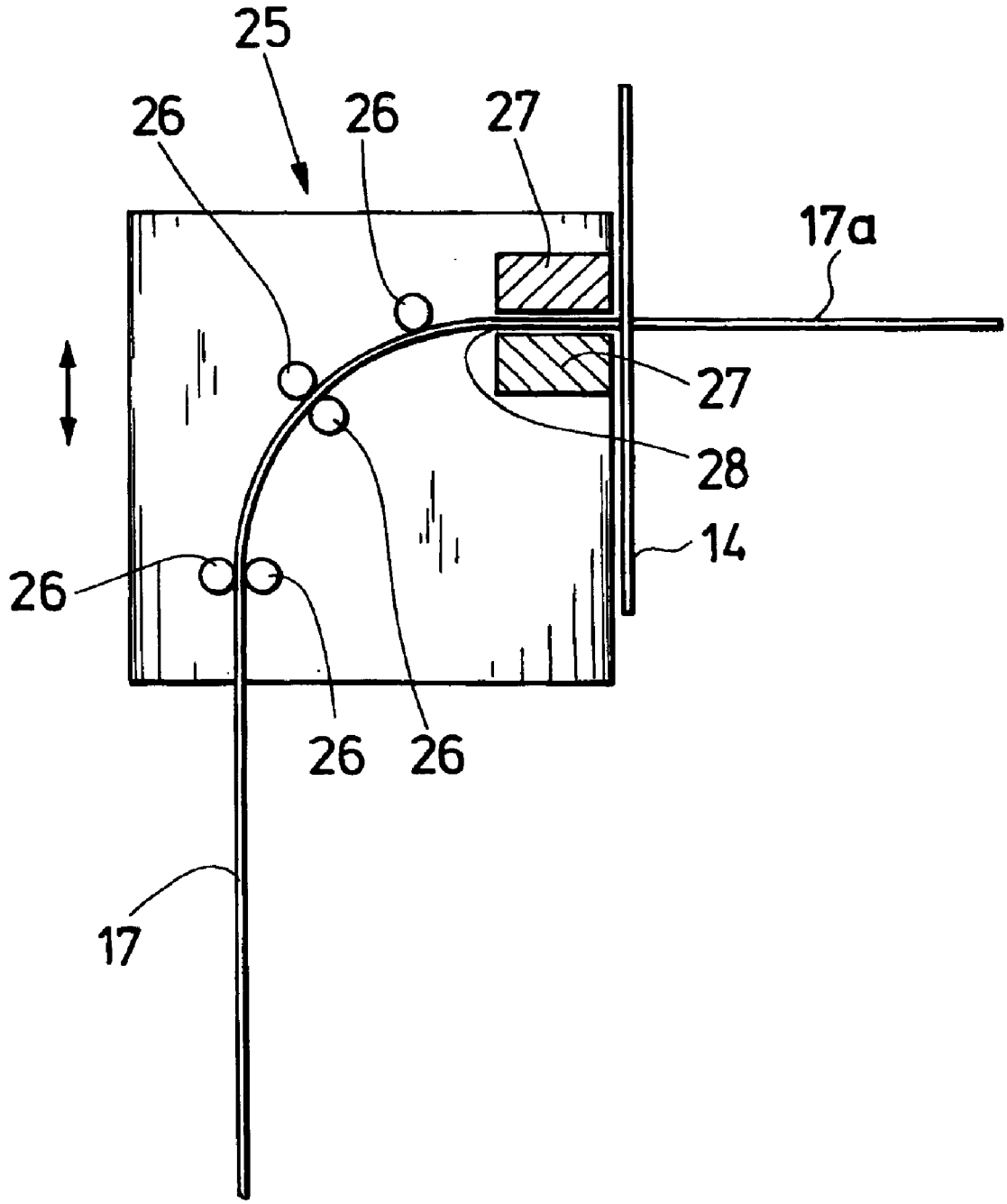
FIG. 2 is a cross-sectional view of a guiding device for a belt element used in the device of FIGS. 1*a*–1*d*.

FIG. 2 shows a vertically displaceable guiding device 25 for the belt element 17. The belt element 17 section on the side of the slide is guided vertically, then bent and redirected by 90° with the aid of rollers 26 of the guiding device 25 such that the belt element section 17*a* can essentially be pushed horizontally into the stack repository 1. To ensure a secure guidance of the belt element section 17*a*, upper and lower holding elements 27 with an opening 28 are provided near the rear stack limit stop 14.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for manipulating sheet stacks in a stack repository, the device comprising:

a sheet feeding device and means for separating adapted to be moved into the stack repository while a sheet stack is conveyed away from the stack repository, wherein the separating means comprises a belt element.

2. The device of claim 1, wherein the belt element is flexible.

3. The device of claim 1, wherein the belt element includes a belt element section that is moved into the stack repository and has a bending elasticity.

4. The device of claim 1, wherein the belt element is a steel belt.

5. The device of claims 1, further comprising at least one guiding device for guiding the belt element.

6. The device claim 5, wherein the guiding device is height-adjustable.

7. The device of claim 1, further comprising at least one drive for driving the belt element.

8. The device of claim 7, wherein the drive is at least one of a motorized drive and a pneumatic drive.

9. The device of claim 1, wherein the belt element is adapted to be moved into the stack repository in a sheet transporting direction.

10. The device of claim 9, further comprising a stack withdrawing device for withdrawing a stack from the stack repository, wherein the belt element is adapted to be moved synchronously with a withdrawing movement of the stack withdrawing device.

11. The device of claim 1, further comprising a separating hook provided at the stack repository.

12. The device of claim 11, wherein the separating hook is arranged opposite the sheet feeding device.

13. A method of separating stacks of sheets in a device for forming sheet stacks in a stack repository and for conveying the sheet stacks away from the stack repository, the device including a sheet feeding device, the method comprising moving a separating mechanism having a belt element into the stack repository; and conveying a sheet stack away from the stack repository, wherein the moving step and the conveying step are synchronous.

14. The method of claim 13, wherein the moving step includes moving a flexible belt element is flexible.

15. The method of claim 13, wherein the moving step includes moving a rigid belt element section into the stack repository.

16. The method of claim 13, wherein the moving step includes guiding a steel belt element.

17. The method of claim 13, wherein the moving step includes guiding the belt element through at least one guiding device.

18. The method of claim 17, wherein the guiding step includes guiding the belt element through a height-adjustable guiding device.

19. The method of claim 13, further comprising driving the belt element with at least one drive.

20. The method of claim 19, wherein the driving step includes driving the belt element with at least one of a motorized drive and a pneumatic drive.

21. The method of claim 13, wherein the moving step includes moving the belt element into the stack repository in a sheet transporting direction.

22. The method of claim 21, wherein the conveying step includes withdrawing the stack with a stack-withdrawing device synchronously with the moving step.

* * * * *